US010259014B2

(12) United States Patent
Rieu et al.

(10) Patent No.: US 10,259,014 B2
(45) Date of Patent: Apr. 16, 2019

(54) SORTING OUTLET MODULE FOR A POSTAL SORTING MACHINE

(71) Applicant: Solystic, Bagneux (FR)

(72) Inventors: Jean Rieu, Saint Georges les Bains (FR); Jacques Chapelet, Porte les Valence (FR); Frederic Mestrallet, Etoiles sur Rhone (FR)

(73) Assignee: SOLYSTIC, Bagneux (FR)

( * ) Notice: Subject to any disclaimer, the term of this patent is extended or adjusted under 35 U.S.C. 154(b) by 64 days.

(21) Appl. No.: 15/517,580

(22) PCT Filed: Jan. 13, 2017

(86) PCT No.: PCT/FR2017/050080

§ 371 (c)(1),
(2) Date: Apr. 7, 2017

(87) PCT Pub. No.: WO2017/162933

PCT Pub. Date: Sep. 28, 2017

(65) Prior Publication Data

US 2018/0193883 A1 Jul. 12, 2018

(30) Foreign Application Priority Data

Mar. 24, 2016 (FR) ..... 16 70131

(51) Int. Cl.
*A47B 88/06* (2006.01)
*A47B 5/00* (2006.01)
(Continued)

(52) U.S. Cl.
CPC ..... *B07C 3/008* (2013.01); *A47B 88/44* (2017.01); *A47B 88/467* (2017.01); *A47B 88/473* (2017.01)

(58) Field of Classification Search
CPC ..... A47F 5/0025; A47B 88/48; B07C 1/025; B07C 3/008
See application file for complete search history.

(56) References Cited

U.S. PATENT DOCUMENTS 2,468,662 A * 4/1949 Glendening ..... A47B 11/00 312/302
2,650,871 A * 9/1953 Holderegger ..... A47B 88/48 16/374

(Continued)

FOREIGN PATENT DOCUMENTS

| | | | | |
|---|---|---|---|---|
| CH | 250545 A * | 8/1947 | ..... | A47F 1/125 |
| CH | 663 883 A5 | 1/1988 | | |
| DE | 203 08 057 U1 | 7/2004 | | |
| DE | 202012102130 U1 * | 9/2013 | ..... | B65G 1/026 |
| EP | 2 152 439 A2 | 2/2010 | | |

*Primary Examiner* — Kimberley S Wright
(74) *Attorney, Agent, or Firm* — Ware, Fressola, Maguire & Barber LLP

(57) ABSTRACT

A sorting outlet module for a postal sorting machine, provided with a bay for receiving a storage tray for storing mailpieces, and, inside the bay, is provided with a support for supporting the storage tray in the manner of a drawer. The support is mounted to move in translation in a longitudinal direction between a storage position in which the tray on the support is retracted inside the bay and a transfer position in which the tray on the support is out of the bay. The support is also provided with pivot and alignment means for pivoting and aligning the tray, which means are arranged in such a manner that pivoting the tray through 90° on the support relative to the longitudinal direction causes one end of tray to be aligned with one side of the bay while also maintaining the tray as close as possible to the bay.

11 Claims, 3 Drawing Sheets

(51) Int. Cl.

| | |
|---|---|
| ***B07C 3/00*** | (2006.01) |
| ***A47B 88/473*** | (2017.01) |
| ***A47B 88/467*** | (2017.01) |
| ***A47B 88/44*** | (2017.01) |

(56) References Cited

U.S. PATENT DOCUMENTS 4,991,914 A * 2/1991 Kerstein ..... B07C 1/025 211/10
6,123,304 A * 9/2000 Bateson ..... A47B 21/0314 248/285.1
6,347,710 B1 * 2/2002 Ryan, Jr. ..... B07C 1/025 209/706
6,702,410 B2 * 3/2004 Kusztal ..... A47B 21/03 248/289.31
7,273,212 B1 * 9/2007 Kolbaba ..... A47B 11/00 108/103
2001/0042706 A1 * 11/2001 Ryan, Jr. ..... B07C 1/025 209/706
2003/0107305 A1 * 6/2003 Kusztal ..... A47B 21/03 312/223.3
2004/0232810 A1 * 11/2004 Kreyenkamp ..... A47B 88/48 312/322
2010/0060114 A1 * 3/2010 Baird ..... A47B 88/48 312/209
2010/0060121 A1 * 3/2010 Helgesen ..... A47B 88/48 312/322
2010/0102689 A1 * 4/2010 Chambers ..... A47B 88/48 312/257.1
2010/0219142 A1 * 9/2010 Chifflet ..... B07C 3/00 211/80

* cited by examiner

SORTING OUTLET MODULE FOR A POSTAL SORTING MACHINE

CROSS REFERENCE TO RELATED APPLICATIONS

This application is the U.S. National Stage of International Application Number PCT/FR2017/050080 filed on Jan. 13, 2017, which application claims priority under 35 USC § 119 to French Patent Application No. 1670131 filed on Mar. 24, 2016. Both applications are hereby incorporated by reference in their entirety.

TECHNICAL FIELD

The invention relates to a sorting outlet module for a postal sorting machine, which module is provided with a bay for receiving a storage tray for storing mailpieces, and, inside the bay, is provided with a support for supporting the storage tray in the manner of a drawer, which support is mounted to move in translation in a longitudinal direction between a storage position in which the tray on the support is retracted inside the bay and a transfer position in which the tray on the support is out of the bay.

The invention also relates to a postal sorting machine for sorting mailpieces, in which machine at least one sorting outlet module is installed.

PRIOR ART

Postal sorting machines are generally equipped with stackers at their sorting outlets so as to stack mailpieces on edge and by destination address. A bay is also provided under each sorting outlet for receiving a storage tray for storing mailpieces. Inside the bay, a moving support is usually mounted for moving the tray horizontally and longitudinally out of the bay, and thus for enabling the mailpieces stacked on edge at the sorting outlet to be loaded into the tray.

Document EP 2 152 439 discloses a device for loading/unloading mailpieces, that device including storage trays placed under a sorting outlet. In that device, the trays are mounted one behind the other on a telescopic moving support and can be moved out of the bay so as to be presented in a "cascade configuration" relative to the sorting outlet. In EP 2 152 439, the mailpieces are stored on edge in a stack in the sorting outlet so as to be loaded in the storage tray on edge and in a stack.

It is very practical to have such a bay under a sorting outlet in order to limit the volume occupied by the trays in the sorting machine. In addition, the empty storage tray being quickly accessible for the sorting operative makes it possible to optimize loading mailpieces into the tray.

In order to optimize space-saving further in sorting machines, the bays are aligned lengthwise under the sorting outlets.

However, in order to reduce the number of sorting passes, the current trend is for increasing amounts of non-uniform mail items (small and large size mail, etc.) to be processed in the same sorting passes so as to be stacked one after another on edge at the sorting outlets.

Most of the trays used are not designed to contain large-size mailpieces on edge because the width of the trays is generally smaller than the lengths of the large-size mailpieces.

That is why, when non-uniform articles are sorted into the sorting outlets, the sorting operatives have to load them flat and lengthwise in the length direction of the storage tray.

Unfortunately, such loading of the stacks forces the sorting operatives (operators) to twist their backs and shoulders awkwardly, and such movements increase the risk of musculoskeletal disorders.

In addition, when loading the stack of mailpieces flat into the tray, the operative has to make sure the orientation of the stack is not changed, so as not to disturb its processing downstream in the sorting process and so as not to generate a new unscheduled sorting pass.

SUMMARY OF THE INVENTION

An object of the invention is thus to remedy the above-mentioned problems by proposing a work-station system that is ergonomic and intuitive for sorting operatives so that the stack of mailpieces is loaded into the tray with the correct orientation.

To this end, the invention provides a sorting outlet module for a postal sorting machine, which module is provided with a bay for receiving a storage tray for storing mailpieces, and, inside the bay, is provided with a support for supporting the storage tray in the manner of a drawer, which support is mounted to move in translation in a longitudinal direction between a storage position in which the tray on the support is retracted inside the bay and a transfer position in which the tray on the support is out of the bay, said sorting outlet module being characterized in that said support is also provided with pivot and alignment means for pivoting and aligning the tray, which means are arranged in such a manner that pivoting the tray through 90° on the support relative to the longitudinal direction causes one end of tray to be aligned with one side of the bay while also maintaining the tray as close as possible to the bay.

The basic idea of the invention is to present the storage tray perpendicularly to the transfer position in a loading position that is ideal and intuitive for the sorting operative. In practice, the mechanical pivoting of the tray advantageously obviates the need for the stack to be pivoted as would normally be done by the sorting operative. In addition, it can be understood that, when the sorting operative retrieves the stack of mailpieces on edge from the sorting outlet, then by merely tipping the stack manually forwards or backwards, it is possible for the mailpieces to be deposited flat in the storage tray (with the destination addresses visible). The idea of the invention also consists in having the loading position as close as possible to and along the bay from which the tray is moved out. Thus, it can be understood that the sorting operative is as close as possible to the sorting outlet for the purpose of transferring the stack of mailpieces from the outlet to the tray. The work station is thus much more ergonomic.

The sorting outlet module of the invention may also have the following features:

- the means are arranged to cause the tray to pivot under the effect of the support moving between its storage position and the transfer position. Thus, it can be understood that the force applied by the sorting operative to move the tray longitudinally towards the transfer position also suffices to turn the tray into the loading position. Only a single movement is thus necessary, consisting in pulling the support outwards from the bay and making it possible to achieve two actions consisting in moving the tray out and in placing it perpendicularly to the sorting outlet.

the means comprise a tray support plate that is mounted to turn about an off-center pivot axis;

the means comprise a set of links;

the support comprises two telescopic runners with return means for urging the support to return to the storage position;

it is provided with an abutment that prevents the tray from pivoting beyond a position at 90° relative to the longitudinal direction; and it is provided with a locking mechanism for locking the storage tray in position at 90° relative to the longitudinal direction.

The invention also provides a postal sorting machine for sorting mailpieces, which postal sorting machine includes a plurality of sorting outlet modules of the invention.

BRIEF DESCRIPTION OF THE DRAWINGS

The present invention can be better understood and other advantages appear on reading the following description and on examining the accompanying drawings, in which.

DESCRIPTION OF EMBODIMENTS

Figure 1:
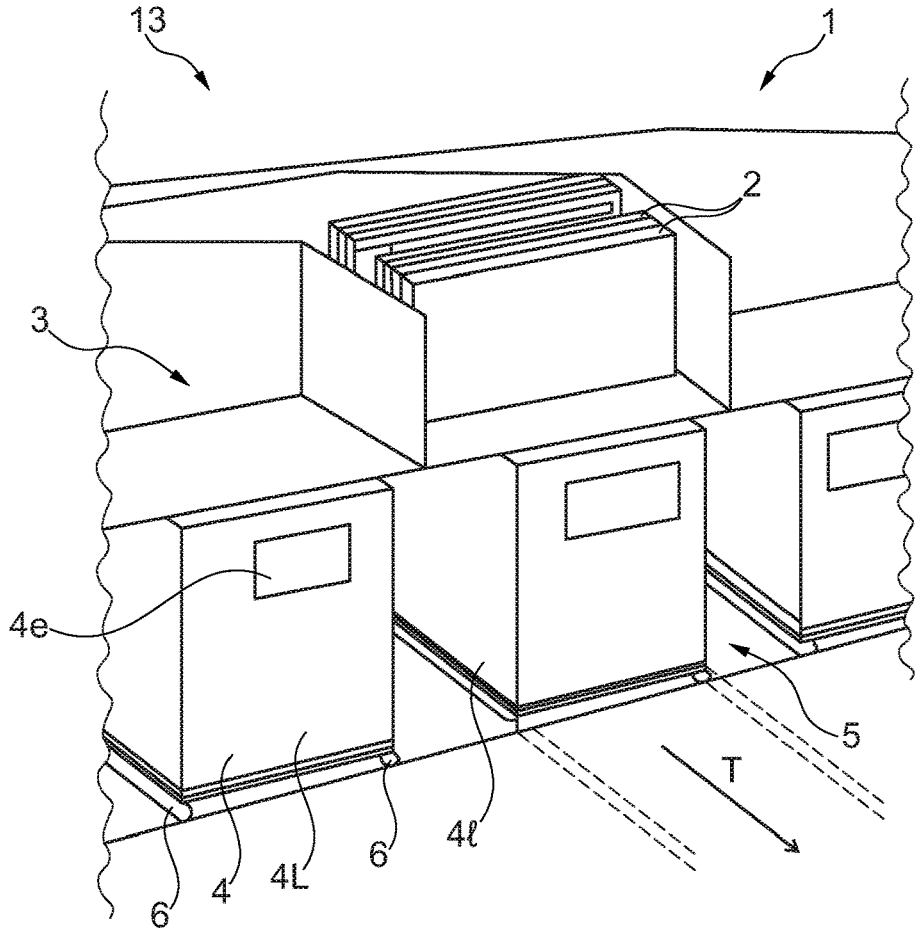
FIG. 1 is a highly diagrammatic view of a portion of a postal sorting machine including a sorting outlet module of the invention.

FIG. 1 is a highly diagrammatic view of a sorting outlet module 1 of the invention, given by way of example, which sorting outlet module is adapted for manually loading mailpieces 2 stacked on edge at a sorting outlet 3 of a sorting machine into a storage tray 4 for storing mailpieces, which tray is dedicated for that purpose.

The type of storage tray used in this example is in the form of a rectangular receptacle comprising two end walls 4L extending widthwise, two side walls 4*l* extending lengthwise, a bottom, and an opening at its top. At least two of its walls, and preferably the widthwise walls 4L, are provided with respective slots 4*e* forming handles for being taken hold of by a sorting operative.

As shown in FIG. 1, each sorting outlet module 1 of the invention comprises a sorting outlet 3 and a bay 5 placed below it and adapted for receiving one or more empty storage trays. The bay 5 may comprise walls and/or a base or merely be in the form of an empty space under the sorting outlet, as shown in FIG. 1. It can be understood that the alignment of the sorting outlets 3 requires the bays 5 to be spaced apart from one another to an extent sufficient to enable a storage tray 4 to be inserted lengthwise.

In this example, each bay 5 is provided with a support 6 for supporting a storage tray 4 in the manner of drawer, which support is mounted to move in translation in the longitudinal direction indicated by arrow T. In this example, the support comprises telescopic runners so as to move in translation out of the bay 5, as shown in dashed lines in FIG. 1. Without restricting the scope of the invention, the moving support 6 may be in the form of slidably mounted bars with rails, or else of bars mounted on wheels. The support may also be provided with fastening or holding means (not shown) for fastening or holding the tray 4 so as to prevent it from tipping while it is being moved.

Figure 3:
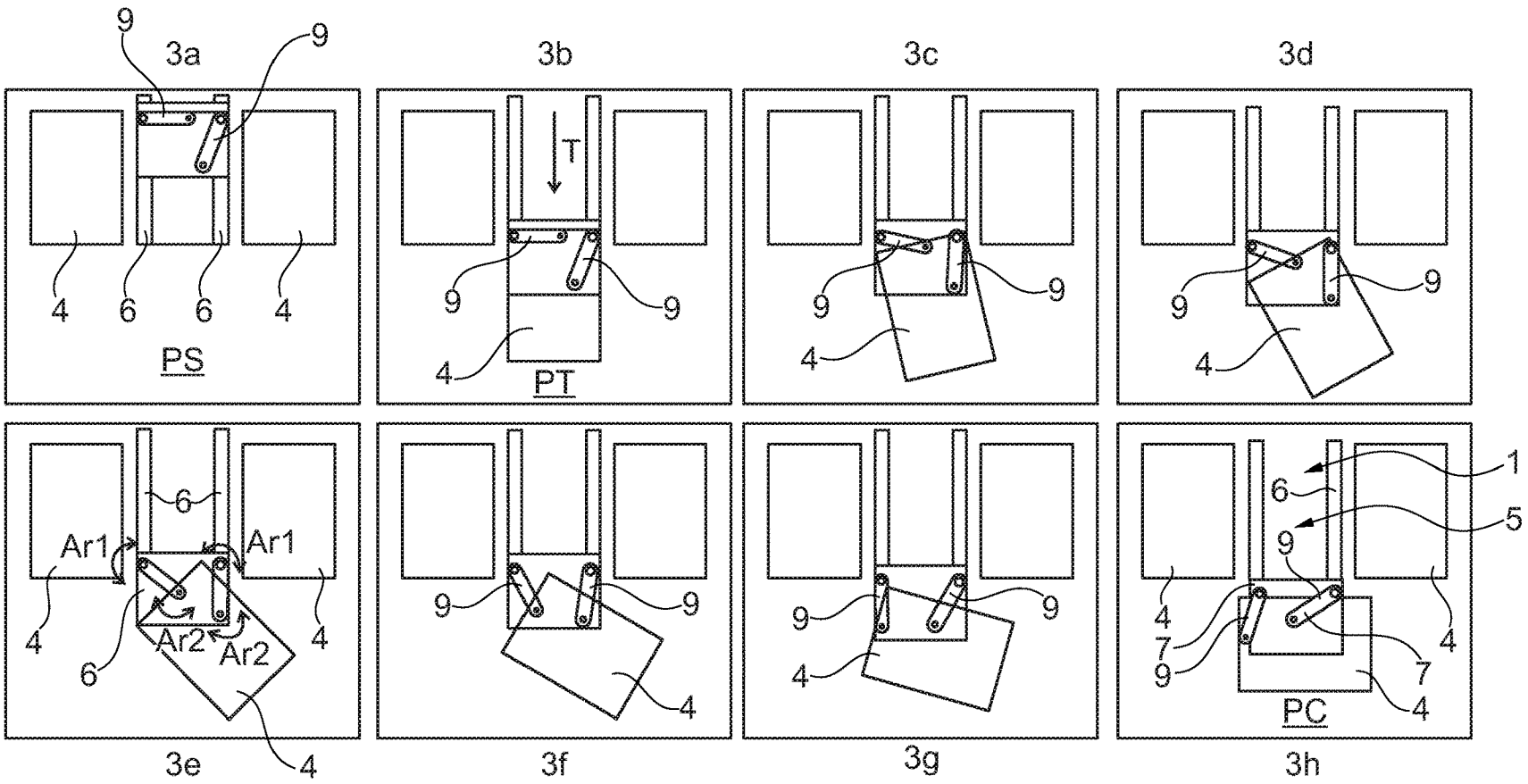
FIGS. 3 and 4 are highly diagrammatic views of a support in another variant of the invention, shown in various operating positions.
Figure 4:
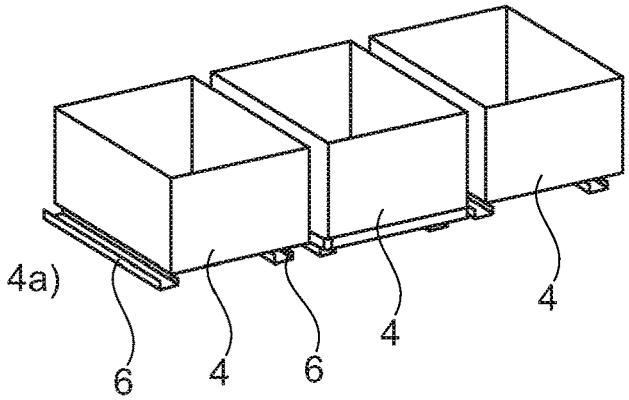
Figure 4:
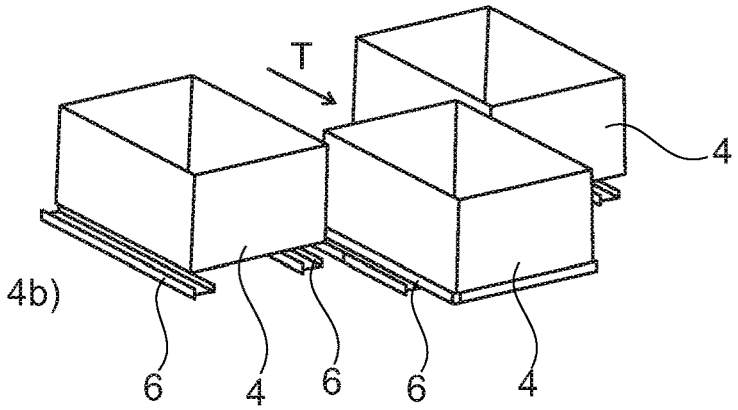
Figure 4:
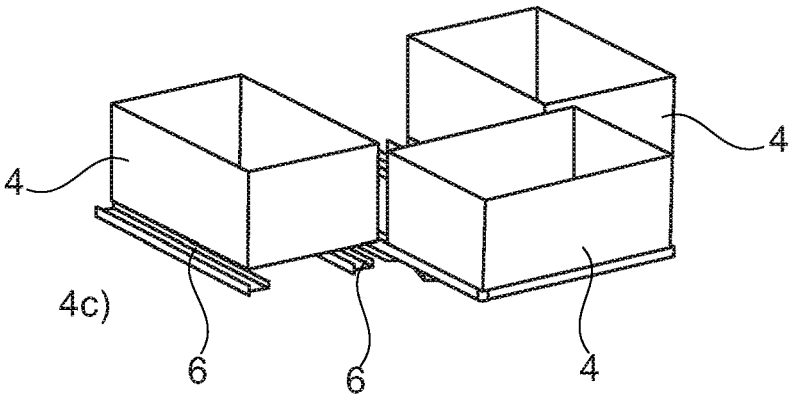

The storage tray 4 can thus be moved by means of the support 6 from a storage position PS in which the support 6 is retracted into the bay 5 under the sorting outlet 3, as shown in FIGS. 1, 3*a*, and 4*a*, to a transfer position PT in which the storage tray 4 is out of the bay 5 (or at least partially out of the bay), as shown in FIGS. 3*b* and 4*b*. The transfer position PT makes it possible to put the storage tray 4 in a "cascade configuration" relative to the sorting outlet 3. Advantageously, the storage position PS and the transfer position PT enable the tray 4 to extend lengthwise relative to the bay in the longitudinal direction indicated by arrow T, as shown in FIGS. 1, 3*b*, and 4*b*.

It can also be understood that, in the storage position PS, the tray 4 is concealed in the bay 5 in such a manner as to leave the space in front of the sorting outlets 3 unobstructed so as to facilitate movement of the sorting operatives.

The support 6 is also provided with pivot and alignment means 7 for pivoting and aligning the tray, as shown in FIGS. 2 and 3*a*-3*h*, which means are arranged to pivot the tray to a loading position PC for loading the tray 4 with mailpieces 2. Thus, in the loading position PC, the tray 4 extends outside the bay 5 in a direction that is perpendicular to the longitudinal direction, as can be seen in FIGS. 3*h* and 4*c*. In this example, the sorting operative needs firstly to pull the support 6 into the transfer position PT, and then to turn the tray 4 using the pivot and alignment means 7 in order to reach the loading position PC.

It can also be understood that the phrase "at least partially out of the bay" is justified when the bays 5 are wide enough to enable their trays 4 to pivot early before it reaches the transfer position PT.

Thus, the earlier the pivoting takes place while the support 6 is moving from the storage position PS to the transfer position PT, the closer the tray 4 in the loading position PC is to the bay 5 outside said bay. The term "closer" may be understood as meaning the tray is at a distance appropriate for a sorting operative to transfer a stack of mailpieces at arm's length from the sorting outlet 3 to the storage tray 4. The distance may thus lie in range a few millimeters (flush) to several tens of centimeters.

In a preferred embodiment of the invention, one of the corners of the tray 4 in the loading position PC is flush with a corner of a tray 4 in the adjacent bay 5 in such a manner that the width of the tray 4 in the loading position is almost in alignment with the length of the tray in the storage position.

Figure 2:
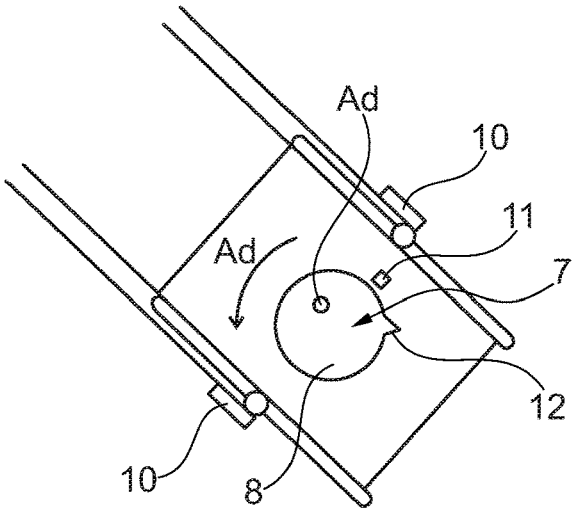
FIG. 2 is a highly diagrammatic view of a support in a variant embodiment of the invention.

In a variant embodiment of the invention, as shown in FIG. 2, the pivot and alignment means 7 may be in the form of a support plate 8 for supporting the tray, which plate is mounted to turn about a pivot axis that is off-center as indicated by arrow Ad. In this example, the plate 8 is in the form of a flat disk.

In another variant embodiment of the invention, as shown in FIG. 3, the pivot and alignment means 7 may be in the form of two links 9. In this example, the links 9 serve as means for receiving the storage tray, i.e. the tray 4 rests essentially on the links 9.

For example, each link may be mounted to move both with the support 6 and also with the storage tray 4, respectively about a first pivot axis Ar1 and about a second pivot axis Ar2, as indicated by the arrows in FIG. 3*e*. It can be understood that the co-ordinated pivoting about the first and second pivot axes Ar1 and Ar2, and the co-ordinated movement of the two links makes it possible to pivot and align the storage tray 4 in the loading position PC.

Advantageously, the means 7 may also be arranged to drive the tray 4 so that it pivots under the effect of the support 6 moving between its storage position PS and the transfer position PT (with or without the variant embodiments of the invention). For example, this drive may be achieved by means of a cam.

The support 6 of the invention may also be provided with return means so as to facilitate moving it from the loading position to the storage position PS. The return means may be in the form of springs 10 mounted at the runners 6 and at the pivot and alignment means 7, as shown in FIG. 2.

The support may also be provided with an abutment 11 that prevents the tray from pivoting beyond a position at 90° relative to the longitudinal direction. For this purpose, the tray-receiving plate 8 is provided with a projection 12 on one of its outside edges, which projection is designed to come to bear against the abutment when the plate 8 is turned until it reaches the loading position PC.

The support 6 may also be provided with a locking mechanism (not shown), for locking the storage tray in position at 90° relative to the longitudinal direction.

The sorting outlet module of the invention may advantageously be provided with a system (not shown) for automatically or manually raising the tray 4 so as to align the tray 4 with the height of the sorting outlet 3.

The invention also relates to a postal sorting machine 13, shown in fragmentary manner in FIG. 1, and including at least one sorting outlet module 1 of the invention.

An example of use of the sorting outlet module 1 comprises the following steps, visible in FIG. 3.

The tray is placed on the support 6 and is held by the fastening means. The sorting operative starts by pulling the support 6 like opening a drawer, so as to move the support 6, and thus the tray 4, longitudinally, out of the bay 5, as shown in FIGS. 3*a* and 3*b*.

The sorting operative continues to pull the support 6 so as to cause the tray 4 to be pivoted and aligned by the pivot and alignment means 7, as shown in FIGS. 3*c* to 3*h*.

Once the sorting operative has positioned the tray 4 in the loading position PC, as shown in FIG. 3*h*, said operative can thus load the mailpieces 2, previously stacked in the sorting outlet 3, into the storage tray 4.

The invention claimed is:

1. Sorting outlet modules of a postal sorting machine for sorting mailpieces said sorting outlet modules being horizontally aligned and each sorting outlet module comprising a postal sorting outlet for stacking on edge mailpieces under which is arranged a bay for receiving a storage tray for storing mailpieces, wherein an inside of the bay is provided with a support for supporting the storage tray in the manner of a drawer, which support is mounted to move in translation in a longitudinal direction between a storage position in which the tray on the support is retracted inside the bay and a transfer position in which the tray on the support is out of the bay; said support comprising pivot and alignment means chosen among a flat disk with an off-center pivot axis or a set of links with two different rotation axes, for pivoting and aligning the tray, which means are arranged in such a manner that pivoting the tray through 90° on the support relative to the longitudinal direction places the support tray in a loading position and causes one end of tray to be aligned with one side of the bay while also maintaining the tray as close as possible to the bay and so that a corner of said support tray is flush with a corner of another support tray in an adjacent bay such that said mailpieces previously stacked in the postal sorting outlet can be loaded into the storage tray by tipping said mailpieces when the storage tray is in the loading position.

2. The sorting outlet modules according to claim 1, wherein said pivot and alignment means are arranged to cause the tray to pivot under the effect of the support moving between its storage position and the transfer position.

3. The sorting outlet modules according to claim 2, wherein each said support comprises two telescopic runners with return means for urging the support to return to the storage position.

4. The sorting outlet modules according to claim 3, wherein each the sorting outlet module is provided with an abutment that prevents the tray from pivoting beyond a position at 90° relative to the longitudinal direction.

5. The sorting outlet modules according to claim 4, wherein the each sorting outlet module is provided with a locking mechanism for locking the storage tray in position at 90° relative to the longitudinal direction.

6. The sorting outlet modules according to claim 5, wherein said pivot and alignment means comprise a tray support plate that is mounted to turn about an off-center pivot axis.

7. The sorting outlet modules according to claim 1, wherein each said support comprises two telescopic runners with return means for urging the support to return to the storage position.

8. The sorting outlet modules according to claim 1, wherein each sorting outlet module is provided with an abutment that prevents the tray from pivoting beyond a position at 90° relative to the longitudinal direction.

9. The sorting outlet modules according to claim 1, wherein each sorting outlet module is provided with a locking mechanism for locking the storage tray in position at 90° relative to the longitudinal direction.

10. The sorting outlet modules according to claim 1, wherein said pivot and alignment means comprise a tray support plate that is mounted to turn about an off-center pivot axis.

11. A postal sorting machine for sorting mailpieces, wherein the postal sorting machine includes the sorting outlet modules according to claim 1.

* * * * *